US008172524B2

(12) United States Patent
Uchise et al.

(10) Patent No.: US 8,172,524 B2
(45) Date of Patent: May 8, 2012

(54) FAN INCLUDING SPECIFIC STATIONARY VANE ARRANGEMENT

(75) Inventors: Hideaki Uchise, Kyoto (JP); Hidenobu Takeshita, Kyoto (JP)

(73) Assignee: Nidec Corporation, Kyoto (JP)

( * ) Notice: Subject to any disclaimer, the term of this patent is extended or adjusted under 35 U.S.C. 154(b) by 1217 days.

(21) Appl. No.: 11/936,238

(22) Filed: Nov. 7, 2007

(65) Prior Publication Data

US 2008/0118379 A1 May 22, 2008

(30) Foreign Application Priority Data

Nov. 16, 2006 (JP) ..... 2006-310609

(51) Int. Cl.
*F04D 29/54* (2006.01)

(52) U.S. Cl. ..... 415/211.2; 415/220; 415/222

(58) Field of Classification Search ..... 415/191, 415/192, 208.2, 209.4, 210.1, 211.2, 220, 415/222

See application file for complete search history.

(56) References Cited

U.S. PATENT DOCUMENTS

| | | | | |
|---|---|---|---|---|
| 2,524,869 | A * | 10/1950 | Adamtchik | 415/210.1 |
| 5,192,190 | A * | 3/1993 | Ferleger et al. | 415/191 |
| 7,275,911 | B2 | 10/2007 | Lee et al. | |
| 7,329,091 | B2 | 2/2008 | Yan et al. | |
| 7,815,418 | B2 * | 10/2010 | Suzuki et al. | 415/222 |
| 2006/0002790 | A1 | 1/2006 | Lu et al. | |
| 2006/0045738 | A1 * | 3/2006 | Lee et al. | 415/220 |
| 2006/0045774 | A1 | 3/2006 | Lu et al. | |
| 2007/0122271 | A1 | 5/2007 | Ishihara et al. | |
| 2007/0122285 | A1 | 5/2007 | Miyazawa et al. | |

* cited by examiner

*Primary Examiner* — Christopher Verdier
(74) *Attorney, Agent, or Firm* — Keating & Bennett, LLP

(57) ABSTRACT

A fan includes an impeller rotatable about a rotation axis and having a plurality of rotating vanes, and a plurality of stationary vanes connecting an outer casing to a supporting body which supports a motor rotating the impeller. At least in a portion of each stationary vane in a radial direction, an axial distance between that stationary vane and one of the rotating vanes closest thereto and a slant angle of that stationary vane with respect to an axial direction increase as that stationary vane moves outwardly in the radial direction.

12 Claims, 5 Drawing Sheets

FAN INCLUDING SPECIFIC STATIONARY VANE ARRANGEMENT

BACKGROUND OF THE INVENTION

1. Field of the Invention

The present invention relates to a fan.

2. Description of the Related Art

Performance of electronic devices has been improved more and more, and therefore the amount of heat generated inside a casing of the electronic devices has been increasing rapidly. Fans have been used in order to reduce the temperature rise in electronic components of the electronic devices.

Fans are used mainly in the following two ways.

(a) To discharge hot air inside a casing of electronic devices to the outside.

(b) To supply an air flow directly to an electronic component which generates heats, thereby reducing the temperature rise of it.

In case of (a), fans are required to provide a large air flow amount and a high static pressure. In case of (b), fans have to provide a desired flow rate distribution in addition to the characteristics required in the case (a). Please note that the flow rate distribution is a distribution of a flow rate of an air flow discharged from an air outlet of a fan. Quietness is also important in both cases. Moreover, fans must have the strength designed in accordance with their operating environment, for example.

In usual fans, an air flow discharged from an air outlet tends to spread outwardly in a radial direction of an impeller because of a centrifugal force generated by rotation of the impeller. In case of (b), however, it is necessary to supply the air flow to a heat-generating electronic component without allowing the air flow to spread outwardly, because a cooling efficiency becomes higher as the air flow amount delivered to the heat-generating electronic component increases.

In order to prevent spreading of the air flow, some fans are provided with stationary vanes at their air outlets. In other fans, ribs are provided between an outer casing and a motor supporting portion such that an axial height of the ribs decreases as they move outwardly in a radial direction of an impeller (see Japanese Patent Unexamined Publication No. 2006-17117, for example).

When the stationary vanes are provided, a noise is caused by interference of an air flow from the impeller with the stationary vanes. That is, measures against the interference noise are required. More specifically, the flow amount of the air flow from the impeller tends to increase from inner ends to outer ends of rotating vanes of the impeller in the radial direction of the impeller. Thus, the interference noise also tends to increase outwardly in the radial direction. The measures against the interference noise should be taken considering the above. In addition, the strength of the stationary vanes should be also taken into consideration.

SUMMARY OF THE INVENTION

According to preferred embodiments of the present invention, a fan includes: an impeller rotatable about a rotation axis, having a plurality of rotating vanes, and taking air in and discharging the air in an axial direction substantially parallel to the axis by rotation thereof; a motor rotating the impeller; an outer casing having an inner peripheral surface which surrounds the impeller; a supporting body arranged substantially at a center inside the outer casing and supporting the motor; and a plurality of stationary vanes radially arranged about the axis to axially face the rotating vanes and connecting the outer casing to the supporting body. At least in a portion of each stationary vane in a radial direction substantially perpendicular to the rotation axis, an axial distance thereof from one of the rotating vanes closest thereto and a slant angle thereof with respect to the axial direction increase as that stationary vane moves outwardly in the radial direction.

According to other preferred embodiments of the present invention, a fan includes: an impeller rotatable about a rotation axis, having a plurality of rotating vanes, and taking air in and discharging the air in an axial direction substantially parallel to the rotation axis by rotation thereof; a motor rotating the impeller; an outer casing accommodating the impeller; a supporting body arranged inside the outer casing and supporting the motor; and a plurality of stationary vanes radially arranged about the rotation axis to axially face the rotating vanes and connecting the outer casing to the supporting body. At least in a portion of each stationary vane in the radial direction, an axial height of a rotating-vane-side edge of the stationary vane, which axially faces the rotating vanes, decreases and a slant angle of the stationary vane with respect to the axial direction increases, as that stationary vane moves away outwardly in the radial direction.

According to still other preferred embodiments of the present invention, a fan includes: an impeller rotatable about a rotation axis, having a plurality of rotating vanes, and taking air in and discharging the air in an axial direction substantially parallel to the rotation axis by rotation thereof; a motor rotating the impeller; an outer casing accommodating the impeller; a supporting body arranged inside the outer casing and supporting the motor; and a plurality of stationary vanes radially arranged about the rotation axis to axially face the rotating vanes and connecting the outer casing to the supporting body. At least in a portion of each of the stationary vanes in the radial direction, an axial height of a rotating-vane-side edge of the stationary vane, which axially faces the rotating vanes, decreases and a thickness of the stationary vane increases, as the stationary vane moves away outwardly in the radial direction.

According to further other preferred embodiments of the present invention, a fan includes: an impeller rotatable about a rotation axis, having a plurality of rotating vanes, and taking air in and discharging the air in an axial direction substantially parallel to the rotation axis by rotation thereof; a motor rotating the impeller; an outer casing accommodating the impeller; a supporting body arranged inside the outer casing and supporting the motor; and a plurality of stationary vanes radially arranged about the rotation axis to axially face the rotating vanes and connecting the outer casing to the supporting body. An axial distance of each stationary vane from one of the rotating vanes closest thereto and a slant angle thereof with respect to the axial direction are larger at an outer end thereof than at an approximate middle thereof in the radial direction.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
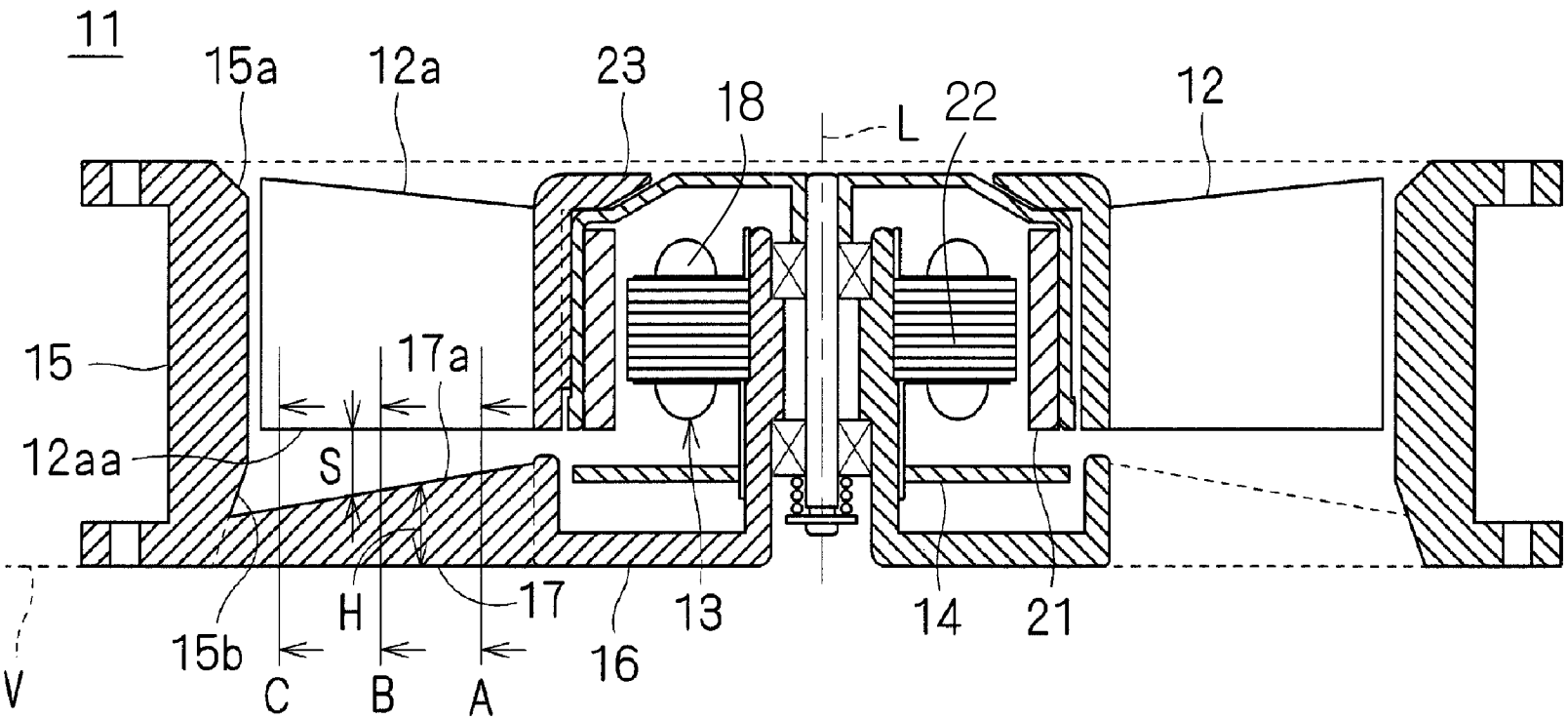
FIG. 1 is a cross-sectional view of a fan according to a preferred embodiment of the present invention.

Referring to FIGS. 1 through 9, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

Figure 2:
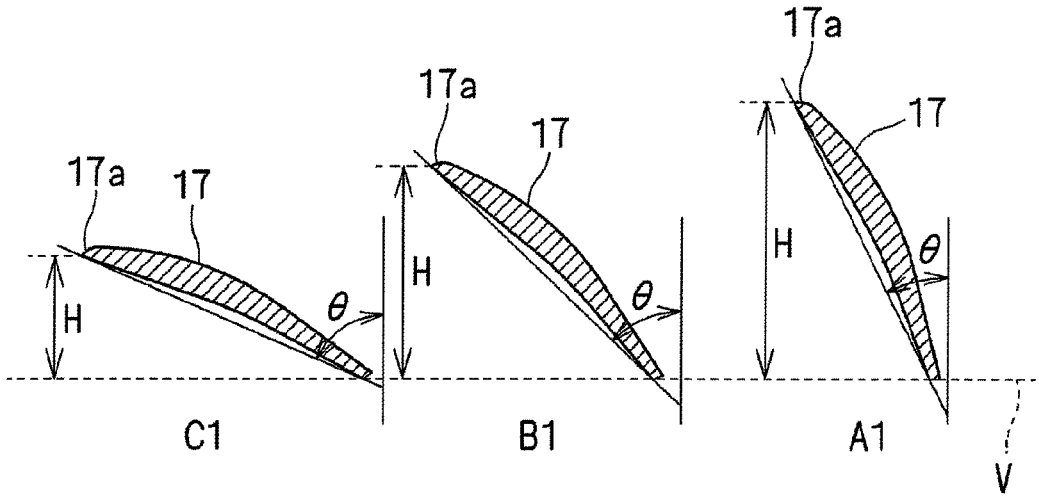
FIG. 2 shows cross sections of a stationary vane of the fan of FIG. 1 at a plurality of positions.

FIG. 1 is a cross-sectional view of a fan according to a preferred embodiment of the present invention. FIG. 2 shows cross sections of a stationary vane of the fan of FIG. 1 at a plurality of positions. In FIG. 2, cross sections A1, B1, and C1 of a stationary vane 17 correspond to positions A, B, and C in FIG. 1, respectively.

Referring to FIG. 1, the fan 11 includes an impeller 12 centered on a rotation axis L, a motor 13, a circuit board 14, an outer casing 15, a supporting body 16, a plurality of stationary vanes 17, and a plurality of wires 18. In this preferred embodiment, the outer casing 15, the supporting body 16, and the stationary vanes 17 are preferably integrally formed from the same material into one component. For example, the outer casing 15, the supporting body 16, and the stationary vanes 17 are formed by integrally molded resin.

The impeller 12 includes a plurality of rotating vanes 12*a*. When the impeller 12 rotates about the rotation axis L, air is taken into and discharged from the fan 11 in an axial direction parallel to or substantially parallel to the rotation axis L. That is, an axial flow is generated. The outer casing 15 is provided to surround the impeller 12 at least in a radial direction perpendicular to or substantially perpendicular to the rotation axis L. The supporting body 16 is arranged inside the outer casing 15 and supports the motor 13 and the circuit board 14.

Each of the stationary vanes 17 extends radially outwardly from the supporting body 16 and has a vane-like shape, e.g., a curved shape in cross section perpendicular to an extending direction of that stationary vane 17. More specifically, the cross section of each stationary vane 17 slants with respect to the axial direction toward a direction opposite to a slant direction of the rotating vanes 12*a* of the impeller 12 and is curved such that its concave surface faces the upstream side in a rotating direction of the rotating vanes 12*a*. With the stationary vanes 17 having such a cross-sectional shape, an air flow generated by rotation of the impeller 12 can be collected toward the rotation axis precisely and efficiently.

The stationary vanes 17 are arranged on the downstream side of the impeller 12 in a direction of the air flow, i.e., on an air-outlet side of the impeller 12 in order to efficiently collect the air flow generated by rotation of the impeller 12. Alternatively, the stationary vanes 17 may be arranged on the upstream side of the impeller 12.

The inner peripheral surface of the outer casing 15 is provided with flare portions 15*a* and 15*b* adjacent to the upstream side opening and the downstream side opening of the fan 11, respectively. The flare portion 15*a* or 15*b* flares radially outwardly such that the inner diameter thereof increases toward the opening adjacent thereto. Radially outer ends of the stationary vanes 17 are connected to the flare portion 15*b* of the inner peripheral surface of the outer casing 15.

The motor 13 includes a rotor magnet 21 attached to the inner peripheral surface of the impeller 12, and an armature 22 which generates a torque between the rotor magnet 21 and the armature 22. The motor 13 is accommodated in a motor cap 23 arranged at or around the radial center of the impeller 12. The circuit board 14 has a control circuit for controlling rotation of the motor 13.

The structure of the stationary vanes 17 and a portion around them in this preferred embodiment are now described referring to the drawings. In this preferred embodiment, as shown in FIGS. 1 and 2, an axial distance S between each stationary vane 17 and one of the rotating vanes 12*a* which is axially closest to that stationary vane 17 and a slant angle θ of each stationary vane 17 with respect to the axial direction both increase as the stationary vane 17 moves outwardly in the radial direction, at least in a portion of the stationary vane 17 in the radial direction. In the shown example, in the substantially entire portion of each stationary vane 17 in the radial direction, both the axial distance S from a rotating vane 12*a* closest thereto and the slant angle θ thereof with respect to the axial direction increase as the stationary vane 17 moves outwardly in the radial direction.

The radially outward increase in the axial distance S between each stationary vane 17 and the rotating vane 12*a* closest thereto is achieved mainly by reducing an axial height H of an edge 17*a* of each stationary vane 17, which faces the closest rotating vane 12*a*, from a predetermined reference plane V as the stationary vane 17 moves radially outwardly. In this preferred embodiment, the reference plane V intersects the rotation axis L of the impeller 12 substantially perpendicularly thereto, and preferably extends along an air-outlet side end of the outer casing 15.

In this preferred embodiment, edges 12*aa* of the rotating vanes 12*a*, which face the stationary vanes 17, are aligned in the radial direction in parallel to or approximately parallel to the reference plane V. Thus, when the axial height H of the rotating-vane-side edge 17*a* of each stationary vane 17 is reduced as it moves outwardly in the radial direction, the axial distance S between that stationary vane 17 and the rotating vane 12*a* closest thereto increases as it moves outwardly in the radial direction. A ratio of reduction in the axial height H of the rotating-vane-side edge 17*a* of each stationary vane 17 (i.e., slant of that rotating-vane-side edge 17*a*) is adjusted in accordance with a ratio of a change in the axial height of the stationary-vane-side edge 12*aa* of the rotating vanes 12*a* from the reference plane V with respect to the radial direction (i.e., slant of the stationary-vane-side edge 12*aa*), for example.

The interference noise, i.e., the noise caused by interference of an air flow with the stationary vanes 17 tends to become louder as the axial distance S between each stationary vane 17 and the rotating vane 12*a* closest thereto becomes smaller. Therefore, in this preferred embodiment, the axial distance S is increased in the substantially entire portion of each stationary vane 17 as the stationary vane 17 moves outwardly in the radial direction. With this arrangement, an air flow sent from the rotating vanes 12*a* can more easily pass between the stationary vanes 17 and the rotating vanes 12*a* in a radially outer region of the fan 11, because the amount of the air flow is larger in the radially outer region of the fan 11. In this manner, the interference noise can be reduced.

Moreover, in the substantially entire portion of each stationary vane 17 in the radial direction, the slant angle θ of thereof with respect to the axial direction increases as it moves radially outwardly. Thus, increase in the axial distance S between that stationary vane 17 and the rotating vane 12*a* closest thereto can be achieved while a required cross-sectional area of each stationary vane 17 for providing the desired strength of the stationary vane 17 is ensured. That is, it is possible to ensure the required strength of the stationary vanes 17 and reduce the interference noise simultaneously.

As described above, in the substantially entire portion of each stationary vane 17 in the radial direction, the axial height H of the rotating-vane-side edge 17*a* of the stationary vane 17 from the reference plane V decreases as it moves radially outwardly. Therefore, the axial length S between each stationary vane 17 and the rotating vane 12*a* closest thereto can be increased as it moves radially outwardly, without requiring a special shape of the rotating vanes 12*a*. Accordingly, it is unnecessary to reduce an axial height of the impeller 12, for example. In this preferred embodiment, it is possible to reduce the interference noise while the performance of the impeller 12 is not changed.

Moreover, since the slant angle θ of each stationary vane 17 is increased as it moves radially outwardly, the adjustment of the axial distance S between each stationary vane 17 and the rotating vane 12*a* closest thereto can be achieved only by changing the structure of the stationary vanes 17. This also contributes to reduction in the interference noise without lowering the performance of the impeller 12.

Since the slant angle θ of each stationary vane 17 is increased as it moves radially outwardly, an occupied area of the stationary vane 17 when the stationary vane 17 is viewed along the axial direction also increases. Thus, it is possible to prevent a reverse air flow, improving the static pressure characteristics of the fan 11.

Figure 3:
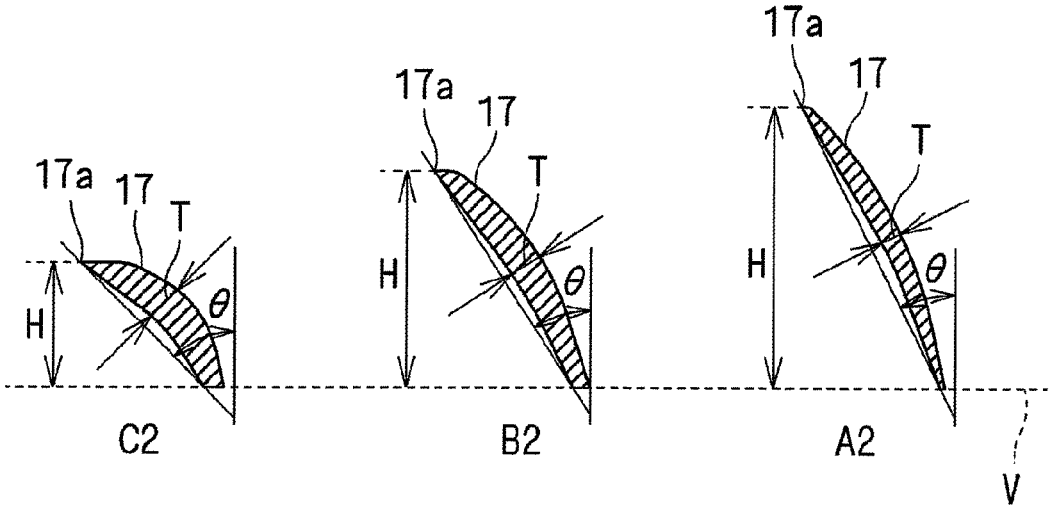
FIG. 3 shows a first variant of the stationary vanes of the fan of the preferred embodiment of the present invention.

Next, variants of the stationary vanes of the fan shown in FIGS. 1 and 2 are described. FIG. 3 shows the first variant of the stationary vanes. In FIG. 3, cross sections A2, B2, and C2 of each stationary vane 17 are obtained by cutting the stationary vane 17 at positions A, B, and C in FIG. 1, respectively.

In the first variant shown in FIG. 3, in the substantially entire portion of each stationary vane 17 in the radial direction, as the stationary vane 17 moves radially outwardly, the axial distance S between the stationary vane 17 and the rotating vane 12*a* closest thereto increases because of the reduction in the axial height H of the rotating-vane-side edge 17*a* of that stationary vane 17. Additionally, the length of a chord between the upper edge 17*a* and a lower edge of the stationary vane 17 also preferably decreases as the stationary vane 17 moves outwardly in the radial direction. Also, in the substantially entire portion of each stationary vane 17, the slant angle e of the stationary vane 17 increases as it moves radially outwardly. In addition, in the substantially entire portion of each stationary vane 17 in the radial direction, the thickness T of the cross section of the stationary vane 17 is also increased, as the stationary vane 17 moves radially outwardly. Please note that "the thickness T of the stationary vane 17" means an average thickness of the cross section of that stationary vane 17 when that stationary vane 17 is cut by a plane parallel to the axial direction and perpendicular or substantially perpendicular to the extending direction of that stationary vane 17.

As described above, in the first variant, in the substantially entire portion of each stationary vane 17 in the radial direction, as the stationary vane 17 moves radially outwardly, not only the axial height H of the rotating-vane-side edge 17*a* of the stationary vane 17 is reduced and the slant angle θ of the stationary vane 17 is increased as in the example of FIG. 2, but also the thickness T of the cross section of the stationary vane 17 is increased. Therefore, it is possible to provide the required strength of the stationary vane 17 more reliably and reduce the interference noise of the air flow with the stationary vanes 17.

Figure 4:
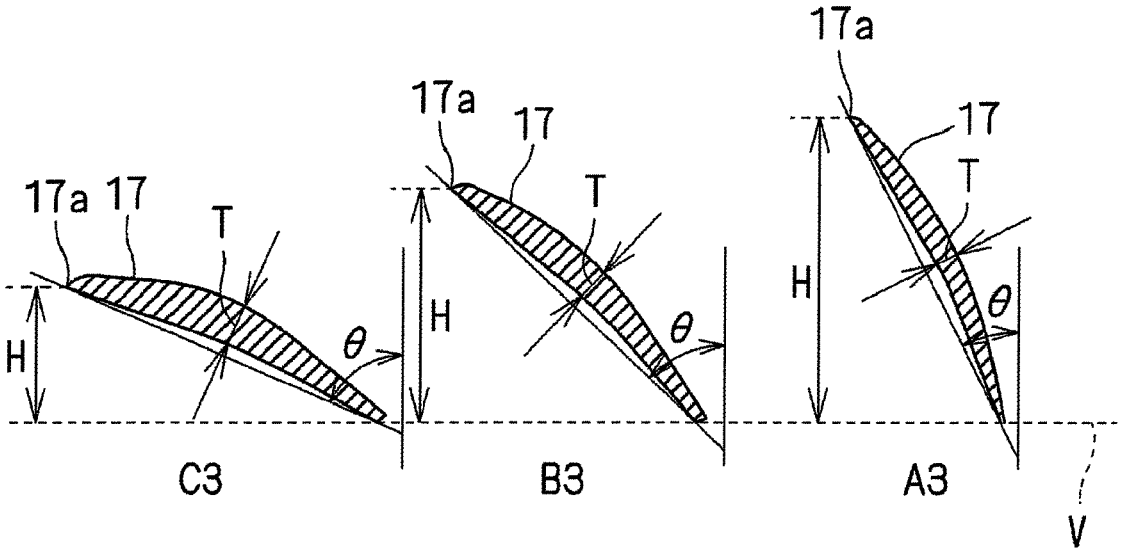
FIG. 4 shows a second variant of the stationary vanes of the fan of the preferred embodiment of the present invention.

FIG. 4 is the second variant of the stationary vanes. In FIG. 4, cross sections A3, B3, and C3 of each stationary vane 17 are obtained by cutting the stationary vane 17 at positions A, B, and C in FIG. 1, respectively.

Also in the second variant, in the substantially entire portion of each stationary vane 17 in the radial direction, as it moves radially outwardly, the axial height H of the rotating-side-vane edge 17*a* of the stationary vane 17 from the reference plane V is reduced thereby increasing the axial distance S between the stationary vane 17 and the rotating vane 12*a* closest thereto. The slant angle θ of the stationary vane 17 is also increased as the stationary vane 17 moves radially outwardly. In addition, in this variant, in the substantially entire portion of each stationary vane 17 in the radial direction, the thickness T (average thickness) of the stationary vane 17 is increased as it moves radially outwardly, and the area of the cross section of the stationary vane 17 when the stationary vane 17 is cut by a plane parallel to the axial direction and perpendicular to its extending direction is constant or approximately constant or increased as it moves radially outwardly. In the example of FIG. 4, the cross-sectional area of each stationary vane 17 is increased as it moves radially outwardly.

With this arrangement, it is possible to reduce the noise of interference between an air flow and the stationary vanes 17 while the desired strength of the stationary vanes 17 is ensured more reliably.

Figure 5:
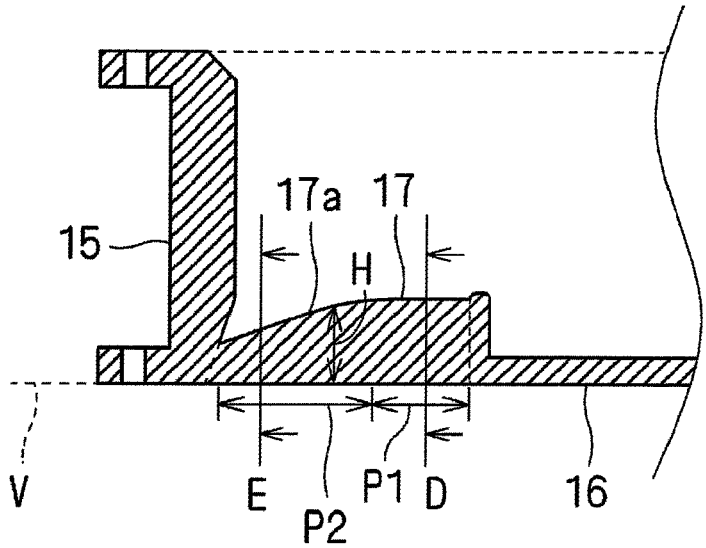
FIG. 5 shows a third variant of the stationary vanes of the fan of the preferred embodiment of the present invention.

FIG. 5 shows the third variant of the structure of the stationary vanes 17. In this variant, one or more measures against the interference noise, e.g., reducing the axial height H of the stationary vanes 17 as it moves radially outwardly are taken only in a portion of the stationary vanes 17 in the radial direction. In the example of FIG. 5, in a portion P1 from a radially inner end to an approximately middle of each stationary vane 17, the measures against the interference noise shown in FIGS. 2 to 4 are not taken. More specifically, the axial height H of each stationary vane 17 and the cross-sectional shape thereof are designed to be approximately constant in the portion P1. In a portion P2 from the approximately middle to a radially outer end of each stationary vane 17, at least one of the measures against the interference noise shown in FIGS. 2 to 4 is taken.

More specifically, in the portion P2 of each stationary vane 17, the axial height H of the rotating-vane-side edge 17*a* is reduced as it moves radially outwardly. In addition, the slant angle θ of that stationary vane 17 is increased as it moves radially outwardly, as described referring to FIGS. 2 to 4. For example, it is assumed that the stationary vane 17 has the cross-sectional shape A1 shown in FIG. 2 at a position D in the portion P1. In this case, the stationary vane 17 is designed to have the cross-sectional shape B1 or C1 at a position E in the portion P2. If the stationary vane 17 has the cross-sectional shape A2 shown in FIG. 3 at the position D, the stationary vane 17 is designed to have the cross-sectional shape B2 or C2 at the position E. If the stationary vane 17 has the cross-sectional shape A3 shown in FIG. 4 at the position D, the stationary vane 17 is designed to have the cross-sectional shape B3 or C3 at the position E.

As described above, even in a case where at least one of the measures against the interference noise, e.g., reduction in the axial height H of the stationary vane 17 is taken only in a portion of the stationary vane 17 in the radial direction, it is possible to reduce the interference noise while the desired strength of the stationary vanes 17 is ensured in that portion. Especially in the structure shown in FIG. 5, the measure against the interference noise is taken in the portion P2 located radially outside the approximately middle of the stationary vane 17 in which the amount of the air flow increases. Therefore, an effect of the measure against the interference noise is large.

Figure 6:
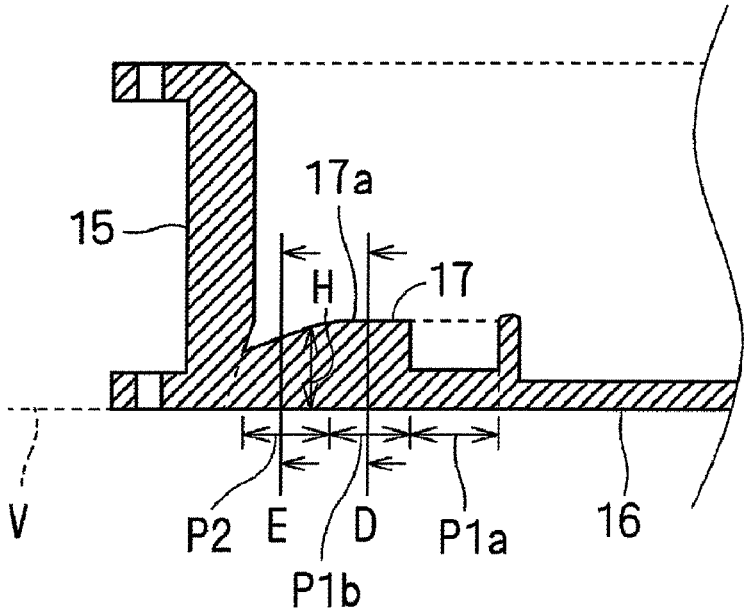
FIG. 6 shows a fourth variant of the stationary vanes of the fan of the preferred embodiment of the present invention.

FIG. 6 shows the fourth variant of the structure of the stationary vanes 17 in the fan 11 shown in FIGS. 1 and 2. Referring to FIG. 6, in a portion P1*a* located radially inside the approximately middle of each stationary vane 17, the amount of an air flow from the rotating vanes 12*a* is small. Therefore, the axial height H of the rotating-vane-side edge 17*a* of each stationary vane 17 can be made lower in the portion P1*a* than in other portions radially outside the portion P1*a*. In the example of FIG. 6, the axial height H of the rotating-vane-side edge 17*a* of the stationary vane 17 is small in the portion P1*a* which extends from the radially inner end of the stationary vane 17 and is located radially inside the approximately middle thereof as if a rotating-vane-side edge 17*a* is cut out.

In the fourth variant shown in FIG. 6, in a portion P1*b* of each stationary vane 17 located between the portion P1*a* and the approximately middle of the stationary vane 17, the axial height H of the rotating-vane-side edge 17*a* is larger than that in the portion P1*a* and is approximately constant in the radial direction. Moreover, the cross-sectional shape of the stationary vane 17, when the stationary vane 17 is cut by a plane parallel to the axial direction and perpendicular to the extending direction of that stationary vane 17, is also approximately constant in the radial direction. In a portion P2 located radially outside the portion P1*b*, i.e., from the approximately middle to the radially outer end of the stationary vane 17, at least one of the aforementioned measures against the interference noise, e.g., reducing in the axial height H of the stationary vane 17 as it moves radially outwardly, is taken. The cross-sectional shapes of the stationary vane 17 at the position D in the portion P1*b* and the position E in the portion P2 are approximately the same as those in the example shown in FIG. 5.

Figure 7:
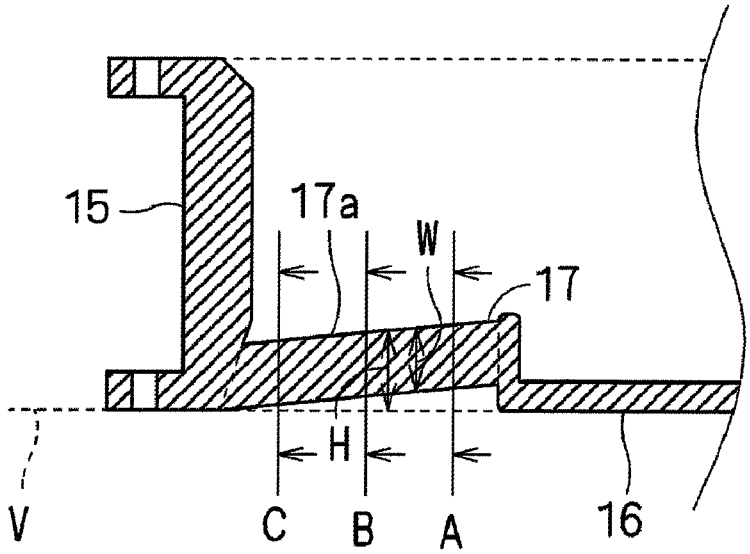
FIG. 7 shows a fifth variant of the stationary vanes of the fan of the preferred embodiment of the present invention.

FIG. 7 shows the fifth variant of the structure of the stationary vanes 17 in the fan 11 shown in FIGS. 1 and 2. Referring to FIG. 7, the axial width W of each stationary vane 17 can be made substantially constant in the radial direction, as long as the axial distance S between that stationary vane 17 and the rotating vane 12*a* closest thereto is increased or the axial height H of the rotating-vane-side edge 17*a* of that stationary vane 17 from the reference plane V is reduced as it moves radially outwardly. In the example of FIG. 7, the cross-sectional shapes of the stationary vane 17 at the positions A, B, and C are approximately the same as any one of those shown in FIGS. 2, 3, and 4.

Figure 8:
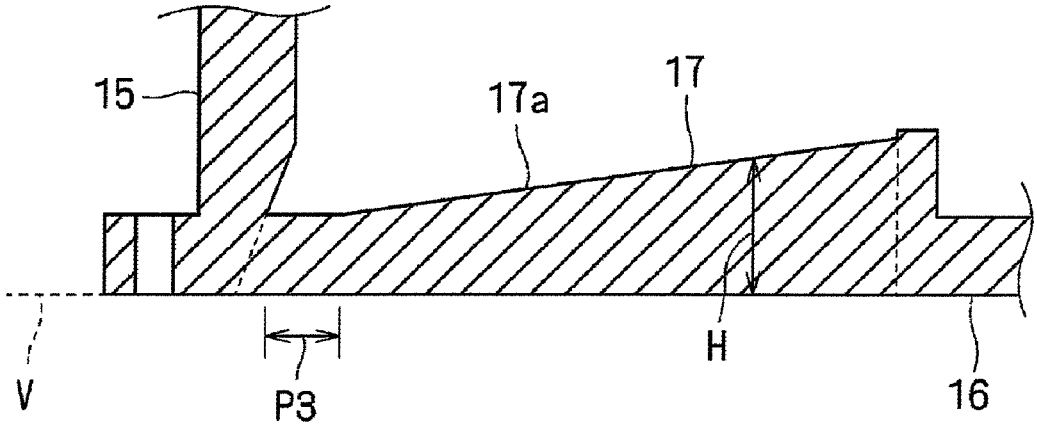
FIG. 8 shows a sixth variant of the stationary vanes of the fan of the preferred embodiment of the present invention.

FIG. 8 shows the sixth variant of the structure of the stationary vanes 17 in the fan 11 shown in FIGS. 1 and 2. Referring to FIG. 8, a portion P3 located radially outside the approximately middle of each stationary vane 17, e.g., a portion P3 located adjacent to the radially outer end of the stationary vane 17 is considered. If a ratio of the length of the portion P3 to the entire length of the stationary vane 17 in the extending direction of the stationary vane 17 is relatively small, the structure contradicting the aforementioned measures against the interference noise can be used. For example, the axial height H of the rotating-vane-side edge 17*a* can be constant in the radial direction or increased as it moves radially outwardly only in the portion P3.

Figure 9:
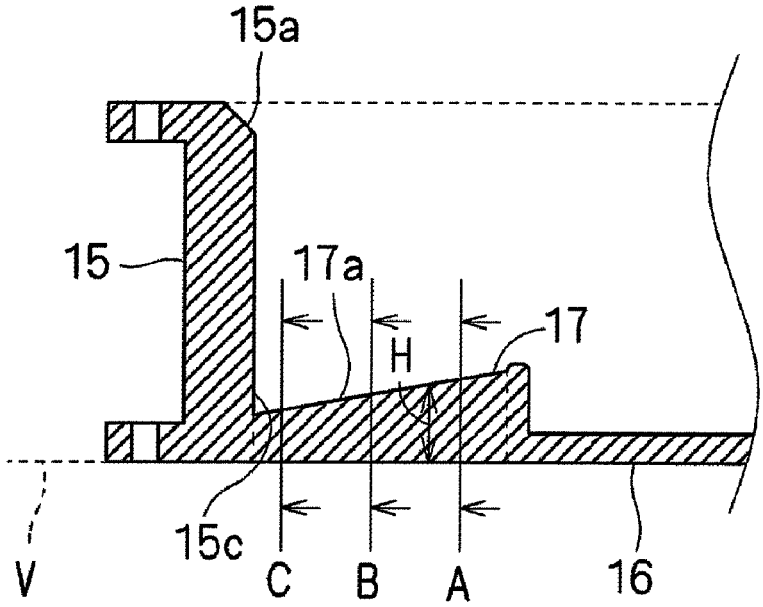
FIG. 9 shows a variant of a structure for connecting the stationary vanes to an outer casing of the fan of FIG. 1.

FIG. 9 shows a variant of a connecting structure between the stationary vanes 17 and the outer casing 15 in the fan 11 shown in FIGS. 1 and 2. As shown in FIG. 9, a portion 15*c* of the inner peripheral surface of the outer casing 15, which defines an opening of the fan 11 and to which the radially outer ends of the stationary vanes 17 are connected, may be designed to be substantially parallel to the axial direction. That is, the flare portion 15*b* in the example of FIGS. 1 and 2 may be omitted. This structure has the following advantage, for example. When the outer casing 15 and the stationary vanes 17 are molded into one component, a mold assembly is axially separated into mold pieces. Thus, in a case where the portion 15*c* of the outer casing 15 is substantially parallel to the axial direction, an unnecessary thick portion is not formed at the connection between the stationary vanes 17 and the outer casing 15. The unnecessary thick portion may interfere with the air flow and cause an interference noise. Accordingly, it is desirable that no unnecessary thick portion is formed at the connection between the stationary vanes 17 and the outer casing 15.

As described above, according to the preferred embodiments of the present invention, at least in a portion of each stationary vane in the radial direction, an axial distance between the stationary vane and a rotating vane closest thereto increases as the stationary vane moves radially outwardly. Therefore, an air flow can more easily pass through that portion of the stationary vane and the closest rotating vane, as the stationary vane moves radially outwardly. This contributes to reduction in an interference noise between the air flow and the stationary vane.

Moreover, at least in the above portion of the stationary vane, a slant angle thereof with respect to the axial direction increases as the stationary vane moves radially outwardly. Therefore, the axial distance between the stationary vane and the closest rotating vane can be enlarged while the required cross-sectional area of the stationary vane for obtaining the desired strength of the stationary vane is ensured. Thus, it is possible to reduce the interference noise and ensure the desired strength of the stationary vane at the same time.

In a case of increasing the slant angle of the stationary vane in the aforementioned manner, the axial distance between the stationary vane and the closest rotating vane can be adjusted only by changing the structure of the stationary vane. Due to this, it is unnecessary to change the axial dimension of an impeller, for example. Thus, the performance of the impeller does not have to be changed. In addition, increasing the slant angle of the stationary angle can improve static pressure characteristics of a fan.

In a case where the aforementioned portion of each stationary portion includes a portion radially outside an approximate middle of thereof in the radial direction, the interference noise between the stationary vane and the air flow can be reduced in a region of the fan radially outside the approximate middle of each stationary vane where the interference noise is large. Thus, this arrangement is advantageous for reducing the interference noise.

In a case where not only the axial distance between each stationary vane and the closest rotating vane but also the slant angle of the stationary vane increase in the substantially entire portion of the stationary vane as the stationary vane moves radially outwardly, it is possible to ensure the required strength of the stationary vane and more largely reduce the interference noise.

When an axial height of a rotating-vane-side edge of the stationary vane which faces the closest rotating vane from a reference plane is reduced as the stationary vane moves radially outwardly, the axial distance between the stationary vane and the closest rotating vane can be adjusted only by changing the structure of the stationary vane. Thus, the performance of the impeller can be kept without reducing an axial width of the impeller.

The cross-sectional area of the stationary vane when it is cut by a plane parallel to the axial direction and perpendicular to the extending direction thereof may be constant or increased at least in the portion described above, as the stationary vane moves radially outwardly. In this case, the required strength of the stationary vane can be kept and reduction in the interference noise between the stationary vane and the air flow can be achieved.

In the above portion of the stationary vane, the thickness thereof may be made larger. In this case, it is possible to keep the required strength of the stationary vane while the interference noise is reduced.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fan comprising:

an impeller arranged to be rotatable about a rotation axis and including a plurality of rotating vanes, the impeller taking air in and discharging the air in an axial direction parallel or substantially parallel to the rotation axis by rotation thereof;

a motor arranged to rotate the impeller;

an outer casing including an inner peripheral surface which surrounds the impeller;

a supporting body arranged substantially at a center inside the outer casing and supporting the motor; and a plurality of stationary vanes arranged about the rotation axis to axially face the rotating vanes and to connect the outer casing to the supporting body, wherein at least in a portion of each of the plurality of stationary vanes in a radial direction perpendicular to or substantially perpendicular to the rotation axis, an axial distance of the stationary vane from one of the rotating vanes closest thereto and a slant angle thereof with respect to the axial direction increase as the stationary vane moves outwardly in the radial direction; and a length of a chord between an upper edge and a lower edge of each of the plurality of stationary vanes decreases as the plurality of stationary vanes move outwardly in the radial direction.

2. A fan according to claim 1, wherein the portion of each of the stationary vanes is a portion outside an approximate middle thereof in the radial direction.

3. A fan according to claim 1, wherein, at least in the portion of each of the stationary vanes, an axial height of a rotating-vane-side edge thereof decreases as the stationary vane moves outwardly in the radial direction.

4. A fan according to claim 1, wherein an axial distance of each of the stationary vanes from one of the rotating vanes closest thereto and a slant angle thereof with respect to the axial direction increase in a substantially entire portion thereof, as the stationary vane moves outwardly in the radial direction.

5. A fan according to claim 1, wherein, at least in the portion of each of the stationary vanes, an area of the stationary vane in a cross section perpendicular or substantially perpendicular to its extending direction is constant at a given radial position.

6. A fan according to claim 1, wherein, at least in the portion of each of the stationary vanes, an area of the stationary vane in a cross section perpendicular or substantially perpendicular to its extending direction increases as the stationary vane moves outwardly in the radial direction.

7. A fan according to claim 1, wherein, at least in the portion of each of the stationary vanes, a thickness of the stationary vane increases as it moves outwardly in the radial direction.

8. A fan comprising:

an impeller arranged to be rotatable about a rotation axis, including a plurality of rotating vanes, and taking air in and discharging the air in an axial direction parallel or substantially parallel to the rotation axis by rotation thereof;

a motor arranged to rotate the impeller;

an outer casing arranged to accommodate the impeller;

a supporting body arranged inside the outer casing and supporting the motor; and a plurality of stationary vanes radically arranged about the rotation axis to axially face the rotating vanes and to connect the outer casing to the supporting body, wherein at least in a portion of each of the stationary vanes in the radial direction, an axial height of a rotating-vane-side edge of the stationary vane, which axially faces the rotating vanes, decreases and a slant angle of the stationary vane with respect to the axial direction increases, as the stationary vane moves away outwardly in the radial direction; and a length of a chord between an upper edge and a lower edge of each of the plurality of stationary vanes decreases as the plurality of stationary vanes move outwardly in the radial direction.

9. A fan according to claim 8, wherein, at least in the portion of each of the stationary vanes in the radial direction, an axial distance of the stationary vane from one of the rotating vanes closest thereto increases as the stationary vane moves outwardly in the radial direction.

10. A fan comprising:

an impeller arranged to be rotatable about a rotation axis, including a plurality of rotating vanes, and taking air in and discharging the air in an axial direction parallel or substantially parallel to the rotation axis by rotation thereof;

a motor arranged to rotate the impeller;

an outer casing arranged to accommodate the impeller;

a supporting body arranged inside the outer casing and supporting the motor; and a plurality of stationary vanes radically arranged about the rotation axis to axially face the rotating vanes and to connect the outer casing to the supporting body, wherein at least in a portion of each of the stationary vanes in the radial direction, an axial height of a rotating-vane-side edge of the stationary vane, which axially faces the rotating vanes, decreases and a thickness of the stationary vane increases, as the stationary vane moves away outwardly in the radial direction; and a length of a chord between an upper edge and a lower edge of each of the plurality of stationary vanes decreases as the plurality of stationary vanes move outwardly in the radial direction.

11. A fan according to claim 10, wherein, at least in the portion of each of the stationary vanes in the radial direction, an axial distance of the stationary vane from one of the rotating vanes closest thereto increases as the stationary vane moves outwardly in the radial direction.

12. A fan comprising:

an impeller arranged to be rotatable about a rotation axis, including a plurality of rotating vanes, and taking air in and discharging the air in an axial direction parallel or substantially parallel to the rotation axis by rotation thereof;

a motor arranged to rotate the impeller;

an outer casing arranged to accommodate the impeller;

a supporting body arranged inside the outer casing and supporting the motor; and a plurality of stationary vanes radically arranged about the rotation axis to axially face the rotating vanes and to connect the outer casing to the supporting body, wherein an axial distance of each of the stationary vanes from one of the rotating vanes closest thereto and a slant angle thereof with respect to the axial direction are larger at an outer end thereof than at an approximate middle thereof in the radial direction; and a length of a chord between an upper edge and a lower edge of each of the plurality of stationary vanes decreases as the plurality of stationary vanes move outwardly in the radial direction.

* * * * *